United States Patent [19]

Fournier

[11] Patent Number: 4,756,278

[45] Date of Patent: Jul. 12, 1988

[54] DEVICE FOR ATTACHMENT OF A TUBE BUNDLE, ESPECIALLY FOR A STEAM GENERATOR

[76] Inventor: Yves Fournier, 26 avenue Lacaille d'Esse, 71520 Chatenoy le Royal, France

[21] Appl. No.: 435,598

[22] Filed: Oct. 21, 1982

[30] Foreign Application Priority Data

Oct. 23, 1981 [FR] France ..... 81-19981

[51] Int. Cl.[4] ..... F22B 37/06

[52] U.S. Cl. ..... 122/511; 122/235 D; 122/493

[58] Field of Search ..... 122/235 D, 235 H, 360, 122/365, 510, 511, 512, 235 A, 493; 285/189, 61; 165/67, 162, 172; 110/336

[56] References Cited

U.S. PATENT DOCUMENTS

| | | | |
|---|---|---|---|
| 3,838,665 | 10/1974 | Astrom | 122/235 A |
| 3,924,676 | 12/1975 | Bennett | 122/510 |
| 4,010,796 | 3/1977 | Scholtus | 165/162 |
| 4,167,211 | 9/1979 | Haller | 165/162 |
| 4,337,827 | 7/1982 | Jabsen | 122/510 |
| 4,356,795 | 11/1982 | Loiez et al. | 122/511 |

FOREIGN PATENT DOCUMENTS

| | | |
|---|---|---|
| 2121348 | 8/1972 | France . |
| 2304048 | 8/1976 | France . |
| 2336621 | 7/1977 | France . |

*Primary Examiner*—Steven E. Warner

*Attorney, Agent, or Firm*—Pollock, Vande Sande & Priddy

[57] ABSTRACT

Device for attachment of a bundle of tubes (3) coiled into a helix according to several cylindrical coaxial layers, comprising longitudinal rods (4) provided with concave cylindrical recesses (16) for receiving each tube portion (3) corresponding to the same cylindrical layer, the rods (4) being so disposed between each layer as to form several flat radial sheets, elements (8) for attachment of the tubes on the rods being interposed between two consecutive rods of a given radial sheet, each attachment element (8) comprising essentially a piece (8) adapted to cover two turns slotted consecutively in the corresponding rod, the device maintaining the tube by pinching in isostatic fashion, the contact between the device (4, 8) and the corresponding tube (3) being localized in three quasi-pinpoint zones (14, 15) of the tube spaced from one another. The device is useful for the support of a bundle of tubes of steam generators of the sodium-water type.

8 Claims, 2 Drawing Sheets

DEVICE FOR ATTACHMENT OF A TUBE BUNDLE, ESPECIALLY FOR A STEAM GENERATOR

The present invention relates to an attachment device of a bundle of tubes coiled into a vertical helix according to several cylindrical axial layers. The invention is particularly applicable to the tube bundle of a steam generator.

In a bundle of tubes coiled into a vertical helix according to several cylindrical axial layers, it is necessary to arrange the tube support elements intended for maintaining these tubes in position in such manner as to maintain a regular space between two consecutive turns of one layer and between two turns belonging to two consecutive layers, while limiting the possibility of angular displacement of the layers with respect to one another.

The tube attachment device should also allow the tube assembly a certain resilience, in such manner that the expansions and the vibrations which may be produced in these tubes to not give rise to abnormally high restraints.

Tube attachment device of the kind described above are already known, and in particular the attachment device which is the subject of French Pat. No. 2,304,048, is known. However, these known devices do not provide all the guarantees of precision and of dependability as regards the force of tightening of each tube and the exact localization of the real contact point between the attachment device and the tube, thus bringing about insufficient precision with respect to the dynamic behavior of the tube as well as its degree of hammering at the level of the attachment devices. In fact, the known devices for the attachment of a bundle of tubes have the disadvantages mentioned above, particularly when the tube bundle constitutes the secondary circuit of a steam generator of the sodium-water type. In effect, in this case, use of warm liquid sodium as well as heat-carrying fluid subjects the steam generator structure to extremely violent thermic shocks because of the exceptionally large thermic conductivity of the liquid sodium. The tubular bundle which constitutes the water-steam circuit is thus subjected to expansions which may vary suddenly over time, as well as to differences in expansion between the different elements constituting it. The tube bundle can also be subjected to vibrations due to the existence of high speed circulation of the liquid sodium about the tubes and of the water vapor at the interior of the tubes. Under these conditions, the attachment devices assume a very great importance and are difficult to design because of the multiple and almost contradictory functions which they must perform, i.e., the precise positioning of the tubes and the dampening of their vibrations, all while allowing their expansion in several directions and avoiding hammering and excessive wear.

The present invention seeks to mitigate the disadvantages cited above.

On the other hand, in existing tubular bundles, the tube attachment devices achieve only one connection which is approximately of the "ball joint" type. The tube is constrained to keep a spatially fixed position at the location of each attachment device, but it can have a certain rotational movement about this point. As a result, the frequency of a tube portion located between two successive attachment devices is relatively low. In order to limit the vibrations in the tubes, it is necessary to distance the frequency of the tube from the excitation frequency. Hence, in practice, since the excitation frequency which derives mainly from the flow of sodium about the tube is relatively low, it is advantageous to attach the tube in such manner that its frequency is as high as possible. The present invention is therefore intended, on the other hand, to provide a tube attachment device such that the frequency of the tube is as high as possible.

The present invention thus relates to an attachment device for a bundle of tubes coiled into a helix accordihg to several cylindrical coaxial layers, comprising longitudinal rods provided with slots of cylindrical form intended to receive each tube portion corresponding to the same cylindrical layer, the said rods thus being disposed between each layer of tubes so as to form several flat radial sheets, tube attachment elements on the rods being interposed between two consecutive rods of a given flat radial sheet, each attachment element comprising essentially one piece capable of covering two turns consecutively slotted in the corresponding rod, the pinching of the tubes between the rod and the corresponding attachment element being accomplished with the aid of a screw screwed into the rod and abutting an attachment element.

According to one essential characteristic of the invention, the attachment device is applied on the tube in isostatic fashion, the contact between the attachment device and the corresponding tube being effected in three quasi-pinpoint zones spaced from one another. Under these conditions, it will be noted that the attachment device achieves embedding of the tube, resulting in a more rigid connection than the "ball joint" connection; this augments the frequency of the tube.

According to another characteristic of the invention, the said screw, which is intended to create the pinching force of the tube, is supported on the attachment element by a ball joint type connection.

According to another characteristic of the invention, the slots of cylindrical form provided in the rod and in the attachment element have a radius of curvature slightly greater than that of the tubes.

According to another characteristic of the invention, after appropriate screwing of the tightening screw, there rotary immobilization of this screw is provided by hammering of a small diameter portion of the attachment element, thus causing crimping of this portion onto a peripheral zone notched in the head of the screw.

Other characteristics and advantages of the invention will appear from the following detailed description of an embodiment, given by way of illustration but not of limitation, with reference to the attached figures.

Figure 4:
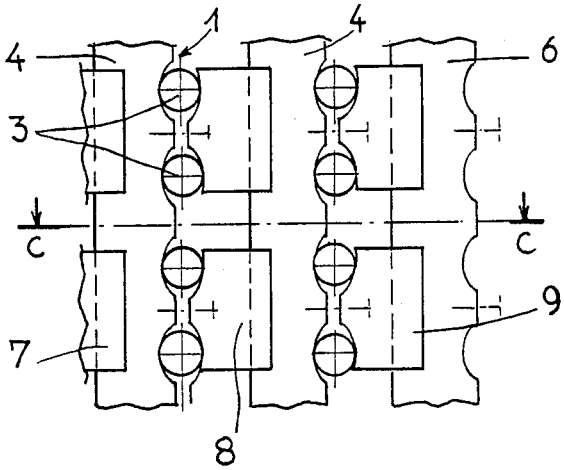
FIG. 4 shows part of an assembly of attachment elements arranged in radial sheets.
Figure 5:
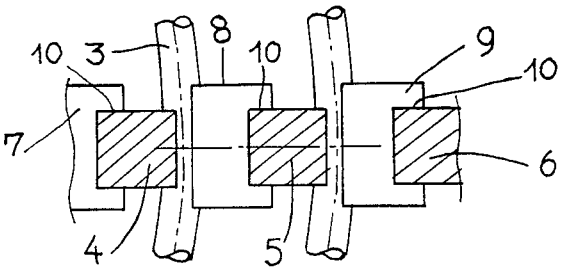
FIG. 5 is a view along line C—C of FIG. 4.

In FIG. 4, which is a view along a radial plane of a steam generator, there can be seen an assembly of tubes 3 arranged along two cylindrical, coaxial layers 1, 2. This FIG. 4 is only a partial view, the entire bundle of tubes 3 being formed in reality of a plurality of cylindrical, coaxial layers extending a certain length, in conventional manner. The tube attachment device is composed mainly of rods 4, 5, 6, longitudinally arranged between each cylindrical layer of tubes, and constituting, in the cylindrical tube assembly, several plane and radial-sheets. Tubes 3 are each arranged in a corresponding cylindrical slot of the different rods 4, 5, 6. On the other hand, the attachment elements 7, 8, 9, also comprising slots intended to adapt themselves to the tubes, are arranged on the other side of the corresponding rods, and assembled to them by an appropriate tightening means. The attachment elements 7, 8, 9 also have, on their face opposite the face which abuts the tubes 3, a longitudinal female slide shape in which the rods 4, 5, 6 corresponding to the succeeding cylindrical layer are positioned. In this manner, the assembly of rods 4, 5, 6 forms a flat, stiff, rigid sheet, since each rod is connected to the preceding and succeeding ones by the interposed attachment elements. This general arrangement of the device for the attachment of a bundle of tubes is known per se. The present invention does not reside in this general arrangement, but resides in an improvement of this attachment device which makes the latter particularly dependable and effective.

Figure 1:
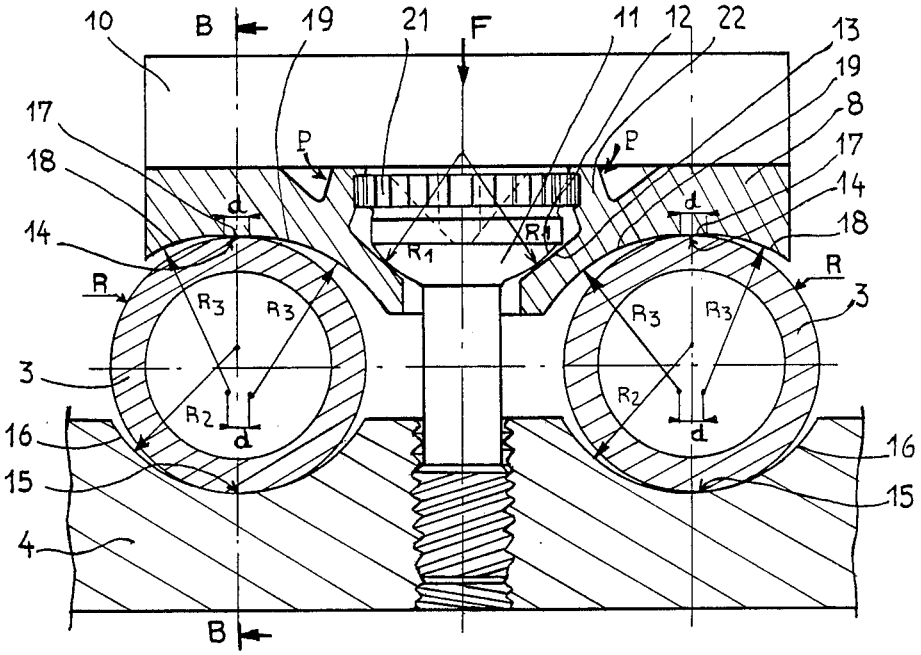
FIG. 1 shows a view along section A—A of an attachment device according to the invention.
Figure 2:
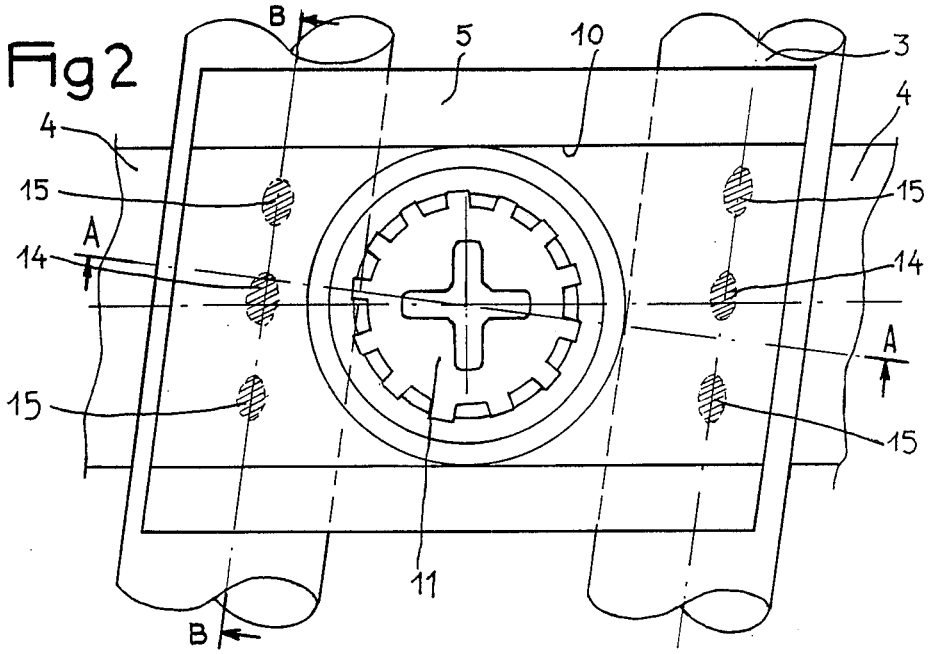
FIG. 2 shows a plan view of the same attachment device.
Figure 3:
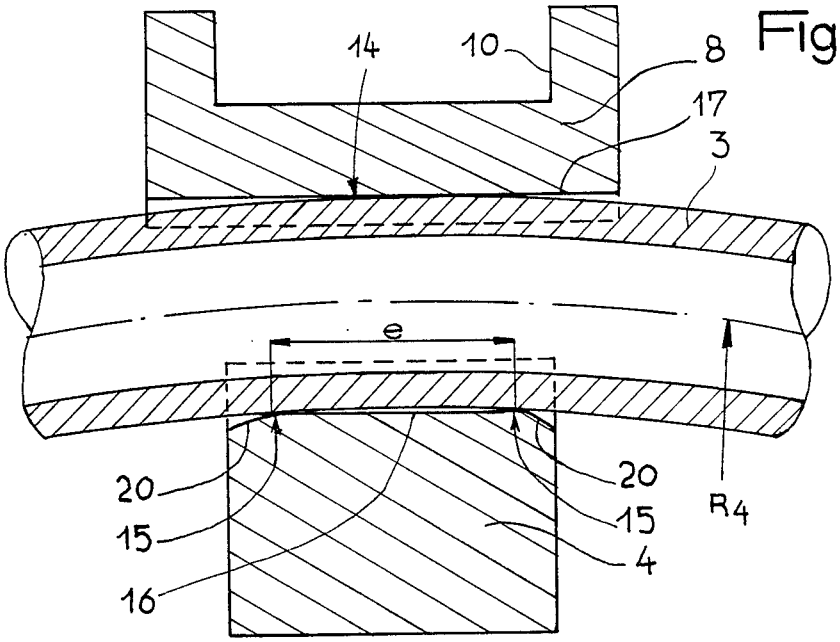
FIG. 3 shows a section B—B of FIG. 1.

With reference to FIGS. 1, 2 and 3, show in detail an embodiment which comprises the advantages which constitute the object of the present invention.

The very special conditions in which a steam generator of the sodium-water type operates, and which have been discussed hereinabove, are such that a tube attachment device which, in other circumstances, would be considered a secondary element, is in the present case, an important element which is dependent on precise technology.

With reference to FIG. 1, there are to be seen two consecutive turns of the tube 3 belonging to the same cylindrical layer of the bundle of tubes, this tube being pinched between the rod 4 which extends longitudinally in the tube bundle, and the attachment element 8. A tightening means 11 causes force F which tends to bring parts 8 and 4 closer together. The tightening element is here constituted by a screw 11 the head of which comprises a base 12 of spherical shape having a radius R1, which comes into abutment with a corresponding conical surface of the attachment element 8. In this manner, the screw 11 brings to bear on the attachment element 8 a force F which remains constant in intensity and direction whatever may be the precise position occupied by the attachment element 8 and the screw 11, the attachment element 8 thus acting like a rocking lever which apportions force F in equal fashion to the two turns of tube 3. In effect, as the attachment element 8 comprises a groove 10 which is engaged with a succeeding rod 5, it follows that the attachment element 8 has a precise position in the space which is determined by the position of the rod 5 in which it is engaged, and the screw 11 should not itself impose a precise position on the attachment element 8 since this attachment element has a position determined by the rod 5. The ball joint type connection 12 of the screw 11 with the attachment element 8 responds well to that condition and consequently results in a mounting which is isostatic. The attachment of the tubes 3 is not dependable unless one knows in advance how to determine the precise position of the points of contact of the tube with its support elements. In the present case, the contact points 14, 15 between the tube and its support elements have been selected diametrically opposite, this being the most rational arrangement. In order to avoid any abnormal hammering of the tube 3 at the level of contact points 14, 15, the surfaces of support of elements 4 and 4 with the tube 3 come into contact with the tube tangentially. In this manner, the restraint at the level of contact of tube 3 progressively decreases between the center of the contact surface 14 or 15 and its periphery. In order to achieve these contacts between two tangential surfaces, there are provided, on the one hand, in rod 4 slots 16 of cylindrical form, intended to receive the tube 3, these slots 16 having a radius R2 slightly larger than the radius R of tube 3, and, on the other hand, the slots formed on the attachment element 8 are constituted by flat surfaces 17 at the level of the contact point 14 to which cylindrical, concave surfaces 18, 19 are to adapt themselves laterally and tangentially, on either side, and having a radius R3 slightly larger than the radius R of tube 3. In order to achieve continuity in the curvature of the slots of the attachment element 8, the centers of the radii of curvature of faces 18 and 19 are spaced at a distance equal to the size d of flat surface 17. It will be noted that the flat surfaces 17 are in a plane which is parallel to the longitudinal axis of the tubular bundle.

FIG. 2 shows an exterior view of the tube attachment device; the device shown is the one which corresponds to the tubes 3 which are rolled helicoidally left-handedly. In this case, the slots arranged in rods 4, 5, 6 and the attachment elements 7, 8, 9 are inclined with respect to the longitudinal axis of the rod at a positive or negative angle equal to the corresponding angle of the left-handed or right-handed helix.

Another aspect of the invention resides in the position of the contact points 14 and 15 with respect to a longitudinal direction of the tube 3, as can be seen particularly in FIG. 3. FIG. 3 shows the tube attachment device according to section B—B. The tube is wound in the bundle, and the radius of curvature R4 of this winding is very large. Because of this, the contact area between the tube 3 and the attachment element 8 does not occur on a generatrix of the surface 17, but in a quasi-pinpoint central area 14. Moreover, for the same reason, the contact area between the tube 3 and the slot 16 of the rod 4 does not occur on a generatrix but in two quasi-pinpoint zones 15 of the lateral parts of rod 4. In order that the contact area 15 not occur on a ridge of the rod 4, which could damage the tube 3 excessively, the extremities 20 of the cylindrical slot 16 are slightly flared. In this way, each tube 3 is maintained in an attachment device according to quasi-pinpoint contact areas 14,15, two areas 15 separated by a certain distance e being located on the face of the tube 3 in the direction of the center of the bundle, and the area 14 being diametrically opposite to the areas 15 and located in a median position. In this manner, whatever may be the movements or the vibrations of the tube 3, the contact points between this tube and the attachment elements remain relatively well defined and localized, and all risks of excessive damage or of tube deformation are avoided. On the other hand, this arrangement creates a support recess, augmenting the flexion frequencies of the tubes. Experiments have shown that this device increases the tube frequency of the tube by about 20%, consequently increasing the dampening factor by about 50% with respect to an attachment device forming a two-point attachment which creates a connection of the "ball joint" type.

With the thought of making the system as reliable as possible, immobilization of the tightening screw after definitive mounting can be provided for. For this purpose, peripheral notches 21 can be provided on this screw, and on the piece 8, a deformable cylindrical portion 22 located in the vicinity of the peripery of the screw head, this portion 22 being intended to be mashed so as to be embedded in the notches 21 of the screw head.

The invention is not limited to the embodiment which has just been described; on the contrary, it comprises all the variant embodiments. It can be applied to any installation in which a helically wound bundle of tubes is to attached under good conditions.

I claim:

1. Device for attachment of a bundle of tubes (3) coiled into a vertical helix having a plurality of cylindrical coaxial layers, said device comprising:

(a) longitudinal rods (4) provided with concave cylindrical recesses (16) for receiving each tube portion corresponding to the same cylindrical layer, said tubes being so arranged between each of said layers as to form a plurality of radial planes; and (b) elements (8) for attachment of said tubes (3) interposed between two consecutive rods (4) of a given radial plane and adapted to cover two turns slotted consecutively in a corresponding rod; and (c) means for maintaining each of said tubes (3) in said attachment device (4, 8) at three quasi-pinpoint contact locations (14, 15) , two of said locations (15) separated by a predetermined distance being located on one face to said tube (3) in the direction of the center of said bundle of tubes, and the third of said locations (14), being diametrically opposite to said two locations (15) and located in a medial position between said two locations.

2. Device according to claim 1, wherein said recesses (16) have a radius (R2) slightly larger than that of said tubes (3), and are flared out adjacent lateral portions (20) of said rod (4), whereby contact between said tube (3) and said rod (4) is always made at said two quasi-pinpoint locations (15).

3. Device according to claim 1, wherein said attachment element (8) comprises two spaced recesses each comprising a flat surface (17) for contacting a said turn corresponding and parallel to the longitudinal axis of said bundle of tubes, whereby contact between said element (8) and said tube (3) is always made at said third quasi-pinpoint location (14).

4. Attachment device according to claim 3, wherein said flat surface (17) of said attachment element (8) on the corresponding turn of said tube (3) is extended on each side by concave cylindrical surfaces (18, 19), said concave surfaces being such that they can never enter into contact with the corresponding tube.

5. Attachment device according to claim 4, wherein said concave cylindrical surface (18, 19) constituting the recesses of said attachment element (8) have a radius slightly greater than the radius of said tube.

6. Attachment device according to claim 1, wherein said maintenance means comprises a screw (11) cut in said rod and abutting said attachment element through the intermediary of a jointed connection.

7. Attachment device according to claim 6, wherein said screw (11) has a spherical head (12) which comes to abut against a conical surface (13) tangential to the spherical surface of said screw head, in such manner that contact between said screw and said attachment element (8) is only made at a surface almost limited to a circle, no matter what the precise position of said attachment element.

8. Attachment device according to claim 6 or 7, wherein the head of said screw (11) comprises peripheral notches (21), and said attachment element comprises, in the vicinity of the periphery of the head of said screw, a deformable cylindrical portion (22) intended for being mashed as a result of being embedded in notches (21) of the head of said screw in order to immobilize it after definitive screwing of this screw during mounting of a bundle assembly.

* * * * *